US010570806B2

(12) United States Patent
Floyd

(10) Patent No.: US 10,570,806 B2
(45) Date of Patent: Feb. 25, 2020

(54) HEAT EXCHANGER HAVING DRAIN PLUG

(71) Applicant: DENSO International America, Inc., Southfield, MI (US)

(72) Inventor: LaDonna Floyd, Royal Oak, MI (US)

(73) Assignee: DENSO International America, Inc., Southfield, MI (US)

( * ) Notice: Subject to any disclaimer, the term of this patent is extended or adjusted under 35 U.S.C. 154(b) by 176 days.

(21) Appl. No.: 15/903,072

(22) Filed: Feb. 23, 2018

(65) Prior Publication Data

US 2019/0264601 A1 Aug. 29, 2019

(51) Int. Cl.
*F28F 11/00* (2006.01)
*F01P 11/02* (2006.01)
*F28D 1/053* (2006.01)

(52) U.S. Cl.
CPC ..... *F01P 11/0276* (2013.01); *F28D 1/05375* (2013.01)

(58) Field of Classification Search
CPC ..... F01P 11/0276; F28D 1/05375
USPC ..... 165/71
See application file for complete search history.

(56) References Cited

U.S. PATENT DOCUMENTS 3,601,181 A * 8/1971 Avrea ..... F01P 11/02 165/51
3,854,526 A * 12/1974 Cole ..... B60T 17/004 165/71
4,006,775 A * 2/1977 Avrea ..... B60K 11/04 165/51
4,130,159 A * 12/1978 Ohta ..... B60K 11/04 123/41.54
4,139,053 A * 2/1979 Schaal ..... F01P 11/0276 165/71
4,449,692 A * 5/1984 Rhodes ..... F16K 5/0414 165/71
4,461,342 A * 7/1984 Avrea ..... F01P 11/02 123/41.54
RE32,434 E * 6/1987 Avrea ..... F01P 11/02 123/41.54
4,679,618 A * 7/1987 Farkas ..... F01P 11/0276 165/71
4,790,369 A * 12/1988 Avrea ..... F01P 11/0238 123/41.51
5,044,430 A * 9/1991 Avrea ..... F01P 11/02 123/41.51
5,762,130 A * 6/1998 Uibel ..... F01P 11/0276 123/41.54
5,899,266 A * 5/1999 Szucs ..... F01P 11/029 123/41.27
5,960,860 A * 10/1999 Kim ..... G05D 23/022 165/51
6,167,946 B1 * 1/2001 Uchikawa ..... F28F 9/002 123/41.14

(Continued)

FOREIGN PATENT DOCUMENTS

CN 204476544 U 7/2015
GB 142247 A 5/1920

*Primary Examiner* — Claire E Rojohn, III

(57) ABSTRACT

A heat exchanger includes a drain assembly having a housing and a drain plug. The drain plug is movably disposed within the housing to extend along the same direction as a drain passage formed in the housing. The drain plug is movable along that same direction to selectively open or close the drain passage. Accordingly, the heat exchanger may be drained with a controllable directional flow.

9 Claims, 6 Drawing Sheets

(56) References Cited

U.S. PATENT DOCUMENTS

| | | | | |
|---|---|---|---|---|
| 6,575,187 | B2 * | 6/2003 | Leys | F16K 11/048 137/15.21 |
| 6,619,380 | B1 * | 9/2003 | Hartman | F01P 11/0276 137/68.19 |
| 6,739,352 | B1 * | 5/2004 | Munro | F01P 11/0276 137/15.13 |
| 7,520,318 | B2 * | 4/2009 | Kwon | F28D 1/0443 165/140 |
| 7,640,966 | B2 * | 1/2010 | Maeda | F28D 1/0435 165/41 |
| 7,708,025 | B2 * | 5/2010 | Johnson | F16K 15/063 137/316 |
| 9,169,945 | B2 * | 10/2015 | Pint | B60H 1/005 |
| 9,732,856 | B2 * | 8/2017 | Farlow | F16K 31/50 |
| 2008/0011971 | A1 * | 1/2008 | Stoll | F16K 24/04 251/89 |
| 2009/0159239 | A1 * | 6/2009 | Desai | F16K 5/0414 165/71 |
| 2019/0264601 | A1 * | 8/2019 | Floyd | F01P 11/0276 |

* cited by examiner

HEAT EXCHANGER HAVING DRAIN PLUG

TECHNICAL FIELD

The present disclosure relates to a heat exchanger which includes a drain plug.

BACKGROUND

Heat exchangers, such as motor vehicle radiators, are often configured to carry one or more coolant to exchange heat between the coolant and, for example, outside air. Such heat exchangers may include a coolant drain assembly for draining the coolant flowing therein. For instance, during servicing of a heat exchanger, an operator may need to drain the heat exchanger. In such cases, it is desirable to provide a drain assembly that improves the draining process.

SUMMARY

According to an aspect of the present disclosure, a heat exchanger includes a drain assembly having a housing and a drain plug. The drain plug is movably disposed within the housing to extend along the same direction as a drain passage formed in the housing. The drain plug is movable along that same direction to selectively open or close the drain passage.

DETAILED DESCRIPTION

First Embodiment

Figure 1:
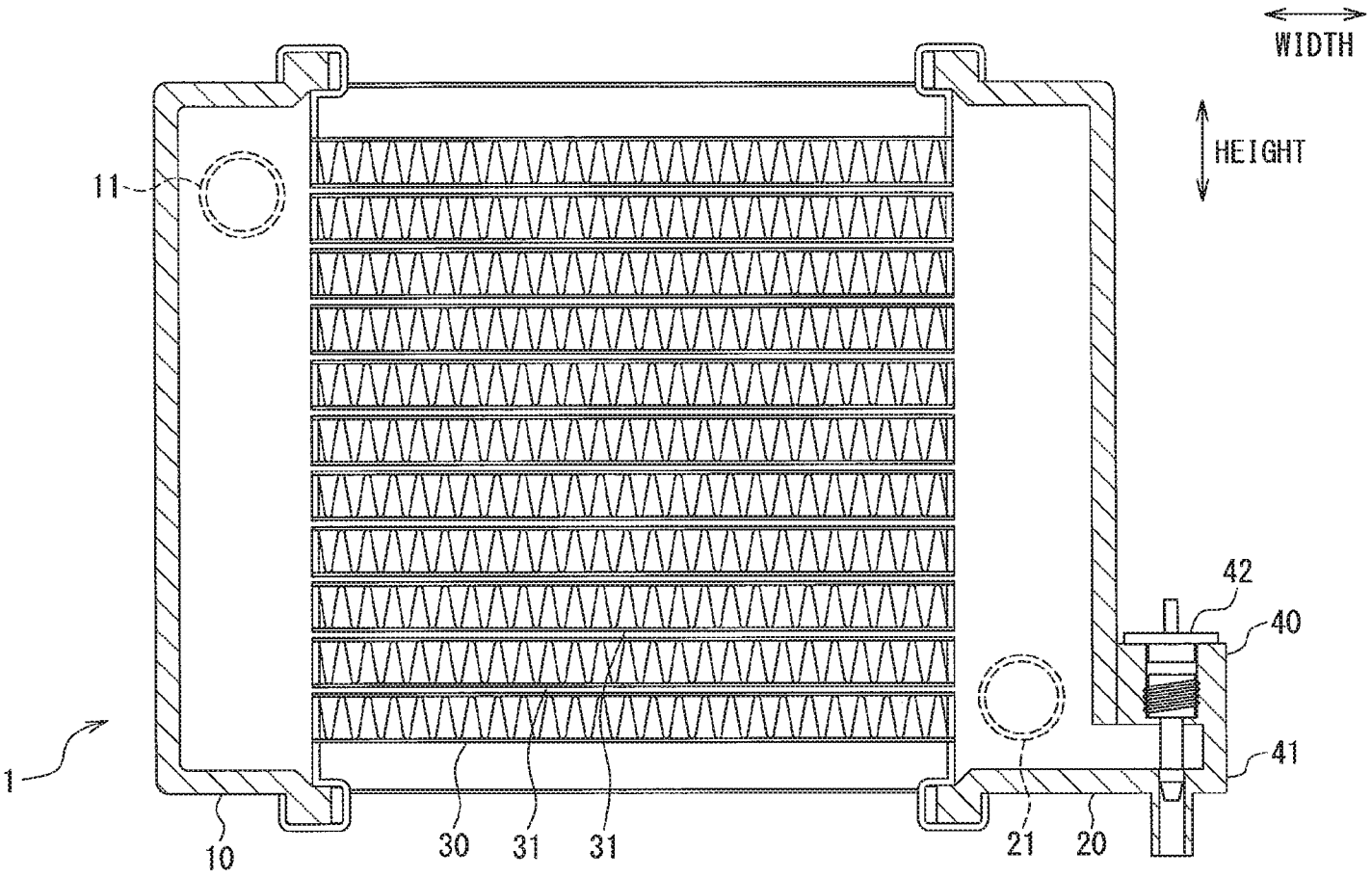
FIG. 1 is a cross section view of a heat exchanger.

FIG. 1 is a cross section view of a heat exchanger 1 according to a first embodiment of the present disclosure. The heat exchanger 1 may be applied as, for example, a motor vehicle radiator. In FIG. 1, a height direction of the heat exchanger 1 corresponds to an up-down direction in the illustration, and a width direction of the heat exchanger 1 corresponds to a left-right direction in the illustration. It should be noted that FIG. 1 is not intended to illustrate the heat exchanger 1 to exact scale with respect to the various components.

In the present embodiment, the heat exchanger 1 is designed to be installed in the orientation as shown, i.e., in a cross-flow configuration. However, as a practical matter, the heat exchanger 1 may be selectively installed in a slightly askew manner (e.g., due to measurement errors or preference), or in entirely different orientations depending on the specific application. As such, terms such as "height", "width", "top", "bottom", "left", "right", etc., as well as derivatives thereof, are used herein for illustrative purposes for facilitating understanding of relative positions and orientations.

As shown in FIG. 1, the heat exchanger 1 includes an inlet tank 10, an outlet tank 20, a plurality of fluid conduits 30, and a drain assembly 40. It should be noted that the heat exchanger 1 may include additional elements typically found in heat exchangers, such as headers and side brackets disposed adjacent to the fluid conduits 30, or mounting brackets for mounting the heat exchanger 1. However, these other elements are omitted from illustration and description for the sake of brevity. In addition, some illustrated components of the heat exchanger 1, such as the fins disposed in between the fluid conduits 30, are not discussed herein for the sake of brevity.

The inlet tank 10 and the outlet tank 20 are each formed in an elongate hollow shape, and may be formed of a metal or resin (e.g., plastic resin) material. Each of the inlet tank 10 and the outlet tank 20 is configured to store a coolant therein. In particular, the inlet tank 10 includes an inlet 11 configured to allow coolant to flow into the inlet tank 10. Similarly, the outlet tank 20 includes an outlet 21 configured to allow coolant to flow out of the outlet tank 20.

The fluid conduits 30 are connected between the inlet tank 10 and the outlet tank 20 to fluidly connect the inlet tank 10 with the outlet tank 20. The fluid conduits 30 are formed as tubes and interleaved with fins, and are preferably formed of a heat conductive material such as aluminum. As illustrated, in the present embodiment, the fluid conduits 30 extend along the width direction of the heat exchanger 1, and are formed to stack along a height direction of the heat exchanger 1, the height direction being orthogonal to the width direction. When coolant flows from the inlet tank 10 to the outlet tank 20 through the fluid conduits 30, the coolant is heat exchanged with, e.g., outside air passing through the heat exchanger 1. It should be noted that descriptions related to orientation herein are intended to cover a range typically associated with measurement errors, manufacturing tolerance, etc. As such, the fluid conduits 30 are not necessarily exactly parallel with the width direction, and may be slightly askew due to typical factors.

The fluid conduits 30 may be attached to the inlet tank 10 and the outlet tank 20 by a variety of manners. For example, each of the inlet tank 10 and the outlet tank 20 may include a header plate (not illustrated) which is coupled to the fluid conduits 30 through, e.g., brazing. As shown in FIG. 1, the elongate inlet tank 10 and outlet tank 20 are arranged to extend along the height direction, i.e., orthogonal to the extension direction of the fluid conduits 30. Further, the inlet 11 of the inlet tank 10 and the outlet 21 of the outlet tank 20 are offset from each other in the height direction. More specifically, the inlet 11 is located higher than the outlet 21 in the height direction. As such, within the inlet tank 10, coolant generally flows in the height direction prior to entering the fluid conduits 30. Similarly, after exiting the fluid conduits 30, coolant generally flows in the height direction within the outlet tank 20.

As shown in FIG. 1, the drain assembly 40 is attached to the outlet tank 20 at a bottom portion of the outlet tank 20. In the present embodiment, the drain assembly 40 includes a housing 41 and a drain plug 42 disposed within the housing 41. The housing 41 may be coupled to the outlet tank 20 through, e.g., brazing, or may be integrally formed with the outlet tank 20.

Figure 2:
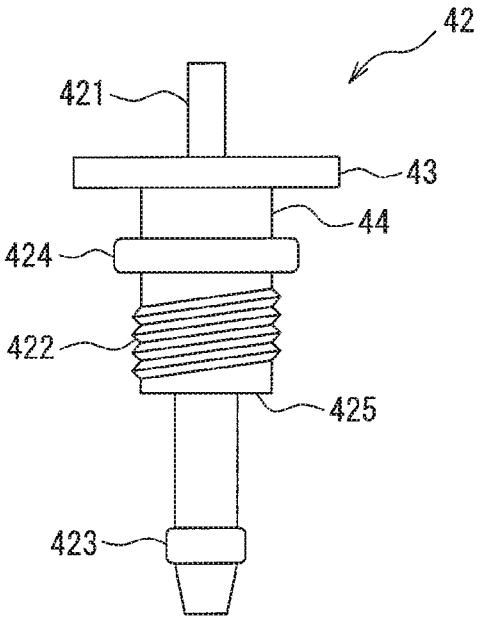
FIG. 2 is a front view of a drain plug.

FIG. 2 is a front view that shows the drain plug 42 in greater detail. As illustrated, the drain plug 42 includes a cap 43 and a body 44. An engagement feature 421 is formed on the cap 43. In addition, a threading 422 is formed on the body 44. Further, a first seal 423 and a second seal 424 are secured to the body 44. The cap 43 is formed in an annular disc shape having a greater radius than the body 44. The body 44 is formed in a cylindrical shape and, in the present embodiment, has sections with varying radii as shown in FIG. 2. In the illustrated example, the proximal (i.e., top) section of the body 44 has a greater radius than the distal (i.e., bottom) section of the body 44, thereby forming a level difference 425 in the center portion of the body 44.

Figure 3:
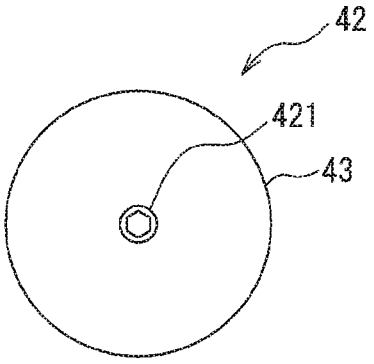
FIG. 3 is a top view of a drain plug.

The engagement feature 421 is disposed at the top end of the drain plug 42, and is configured to be manipulated by an operator or an external tool in order to rotate the entire drain plug 42. For example, FIG. 3 is a top view of the engagement feature 421 and shows an exemplary hexagonal feature for interfacing with a hexagonal tool. The engagement feature 421 is not limited to such a structure, and a variety of alternatives are contemplated as long as engagement with external tools or operators is possible.

The threading 422 formed on the body 44 of the drain plug 42 is configured to engage the housing 41 to convert a rotation of the drain plug 42 into an up-down movement of the drain plug 42 with respect to the housing 41. The functions of the first seal 423 and the second seal 424 will be described in detail later with respect to FIGS. 4A and 4B.

The drain plug 42, aside from the first seal 423 and the second seal 424, is preferably integrally formed, e.g., from metal casting or resin (such as plastic resin). In alternative embodiments, the cap 43 and the body 44 may be formed separately and coupled together through, e.g., brazing. The first seal 423 and the second seal 424 are preferably formed of an elastic material such as rubber, and are fixedly secured to the drain plug 42. For example, rubber gaskets or rubber O-rings may be used as the first seal 423 and the second seal 424. In addition, the first seal 423 and the second seal 424 may be secured to the body 44 in a variety of manners, such as through annular grooves (not illustrated) formed on the outer circumferential surface of the body 44.

Figure 4A:
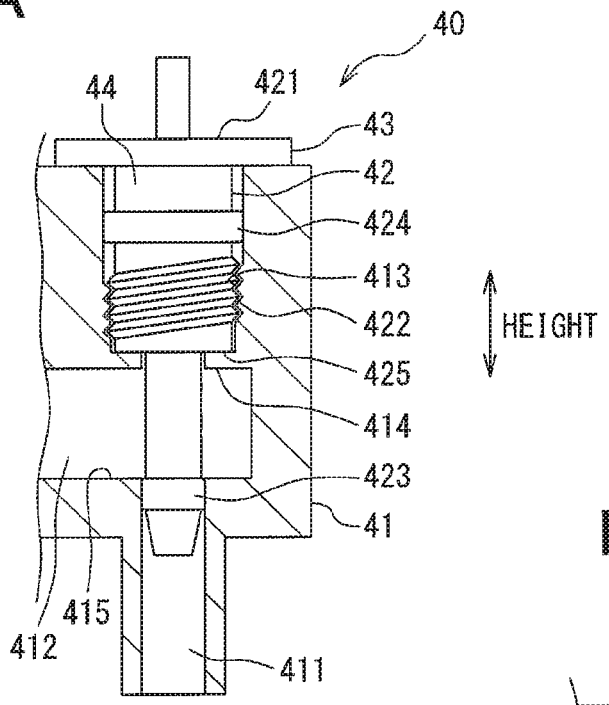
FIG. 4A is a cross section view of a drain assembly.
Figure 4C:
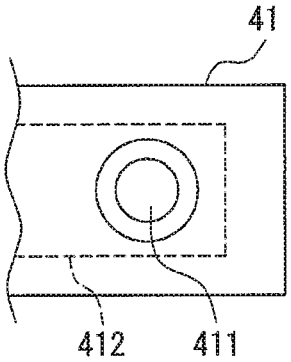
FIG. 4C is a bottom view of a drain assembly.
Figure 4B:
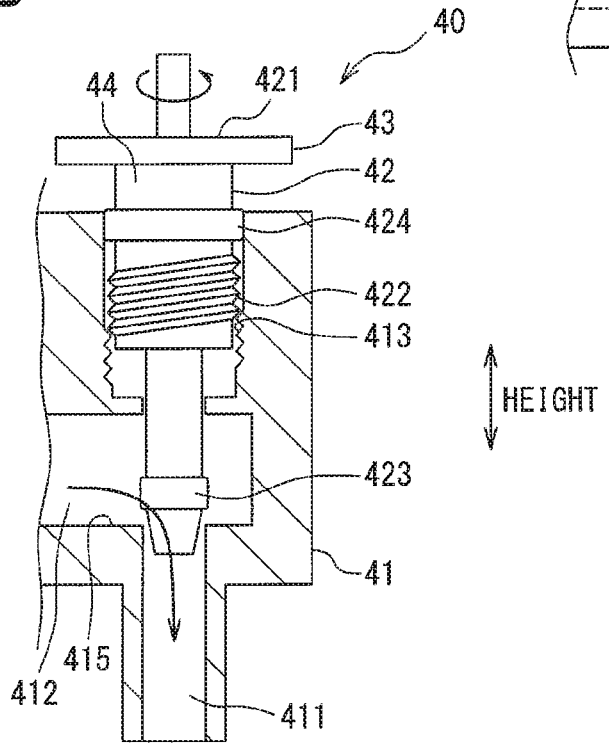
FIG. 4B is a cross section view of a drain assembly.

FIGS. 4A and 4B show the drain plug 42 disposed within the housing 41 in a closed position and an open position, respectively. First, the structure of the housing 41 will be explained.

As illustrated in FIG. 4A, a drain passage 411 and a drain chamber 412 are formed within the housing 41. The drain passage 411 is an annular passage formed at the lower end portion of the housing 41, and is directly connected to the drain chamber 412. In turn, the drain chamber 412 directly opens into the interior of the outlet tank 20. As such, one end of the drain passage 411 (i.e., the top end) is connected to the outlet tank 20 to be in fluid communication with the outlet tank 20. The other end of the drain passage 411 (i.e., the bottom end) opens to outside to allow coolant to flow out therefrom. Here, a bottom wall 415 of the drain chamber 412 is level with the bottom wall of the interior of the outlet tank 20 (see FIG. 1). In other words, the drain chamber 412 is formed at the lowest level of the outlet tank 20, thereby allowing the drain assembly 40 to drain substantially all of the coolant inside the heat exchanger 1.

FIG. 4C is a bottom view of the housing 41. As illustrated, when viewed from the bottom, the drain passage 411 is entirely surrounded by the drain chamber 412. In other words, the flow of coolant is not limited by the open cross sectional area of the drain chamber 412, but is instead limited by the open cross sectional area of the drain passage 411.

In addition, as shown in FIG. 4A, a plug chamber 413 is formed in the housing 41 as an annular hole and opens at the top surface of the housing 41. In this manner, the plug chamber 413 opens at an opposite side of the housing 41 as the drain passage 411. The annular plug chamber 413 is coaxial with the annular drain passage 411 along the height direction. The plug chamber 413 is provided to receive the drain plug 42. A threading (not illustrated) is formed on the inner circumferential wall (i.e., inner side wall) of the plug chamber 413 to engage with the threading 422 of the drain plug 42. For example, the threading 422 of the drain plug 42 may be an external thread, while an internal thread may be formed on the inner side wall of the plug chamber 413. The plug chamber 413 is separated from the drain chamber 412 by a throughhole 414 formed on the bottom surface of the plug chamber 413. When the plug chamber 413 receives the drain plug 42, the distal section of the body 44 is inserted through the throughhole 414 to reach the drain passage 411, as will explained below.

Returning to FIG. 4A, as illustrated, the drain plug 42 is disposed within the housing 41 so as to extend along the height direction of the heat exchanger 1. In this regard, the drain plug 42 is disposed to be coaxial with both the plug chamber 413 and the drain passage 411 in the height direction. The drain plug 42 is coupled to the housing 41 due to the threading 422 of the drain plug 42 engaging with the corresponding threading (not illustrated) formed in the plug chamber 413. Accordingly, the drain plug 42 is configured to be movable in the height direction with respect to the housing 41 by being rotated, i.e., by way of the engagement feature 421, to thread or unthread the body 44 with respect to the plug chamber 413.

In FIG. 4A, the drain plug 42 is in a closed position within the housing 41. The drain plug 42 may be moved to this position by being rotated to thread the body 44 with respect to the plug chamber 413. In this position, the level difference 425 of the drain plug 42 abuts a bottom surface of the plug chamber 413, thereby preventing the drain plug 42 from further moving downward with respect to the housing 41. The cap 43 of the drain plug 42 has a greater radius than the plug chamber 413, and covers the opening of the plug chamber 413. In other words, a distance in the height direction between the cap 43 and the level difference 425 is equal to the depth of the plug chamber 413, such that the level difference 425 abuts the bottom surface of the plug chamber 413 when the cap 43 abuts the top surface of the housing 41.

In alternative implementations, the distance between the cap 43 and the level difference 425 may be slightly greater than the depth of the plug chamber 413, such that when the level difference 425 abuts the bottom surface of the plug chamber 413, a small gap is provided between the cap 43 and the top surface of the housing 41. Further, this small gap between the cap 43 and the housing 41, this gap may be substantially eliminated or closed by, e.g., providing a seal member (not illustrated) between the cap 43 and the housing 41.

In the closed position, body 44 of the drain plug 42 spans across the drain passage 411, the drain chamber 412, and the plug chamber 413 such that the first seal 423 is disposed inside the drain passage 411 and the second seal 424 is disposed inside the plug chamber 413. In other words, a distance between the level difference 425 of the drain plug 42 and the first seal 423 is greater than the height of the drain chamber 412. As shown in FIG. 4A, in the closed position, the first seal 423 is preferably entirely disposed within the drain passage 411. However, in alternative embodiments, the distance between the level difference 425 of the drain plug 42 and the first seal 423 may be reduced as compared to the configuration shown in FIG. 4A, such that the first seal is partially disposed within the drain chamber 412 and partially disposed in the drain passage 411 when the drain plug 42 is in the closed position.

The first seal 423 is configured to, when uncompressed, have a greater radius than the drain passage 411. In this regard, when the first seal 423 is disposed within the drain passage 411, the first seal 423 is compressed to completely block the drain passage 411 to prevent coolant from being drained (i.e., sealed). Similarly, the second seal 424 is configured to, when uncompressed, have a greater radius than the plug chamber 413. In this regard, when the second seal 424 is disposed within the plug chamber 413, the second seal 424 is compressed to completely block the plug chamber 413 to prevent any coolant from exiting upward through the plug chamber 413 (i.e., sealed).

FIG. 4B shows the drain plug 42 in an open position within the housing 41. In this position, the drain plug 42 is displaced upward from the housing 41 as compared to the closed position of FIG. 4A. This is accomplished by rotating the drain plug 42, i.e., by way of the engagement feature 421, thereby unthreading the body 44 with respect to the plug chamber 413, and displacing the drain plug 42 upward with respect to the housing 41. In the open position, the drain plug 42 is displaced away from the drain passage 411 as compared to when the drain plug 42 is in the open position such that the first seal 423 is disposed outside of the drain passage 411. As a result, the drain passage 411 is at least partially open to allow coolant to drain therefrom.

Here, the distal tip of the body 44 of the drain plug 42 may be shaped appropriately to control the flow of the coolant as desired based on the specific application, and so the present disclosure is not intended to be limited to the illustrated shape of the body 44. For instance, while in the present embodiment the distal tip of the body 44 is illustrated as having a tapered shape that extends past the first seal 423, in alternative embodiments, the distal tip of the body 44 may stop at the seal 423 instead (i.e., so as to not extend past the seal 423). In further alternative embodiments, the distal tip of the body 44 may be a more or less tapered shaped as compared to the configuration shown in FIG. 4A, so as to allow a higher or lower flow rate when in the open position.

When the drain plug 42 is in the open position, the second seal 424 is preferably maintained within the plug chamber 413 to prevent draining coolant from exiting upward through the plug chamber 413. However, the drain plug 42 is not prevented from further upward movement (i.e., by further unthreading the threading 422). Accordingly, the drain plug 42 may be entirely removed from the housing 41 by further rotation. In the present embodiment, the open position of the drain plug 42 is defined as any position where the first seal 423 is outside of the drain passage 411.

The drain assembly 40 as described above confers numerous technical advantages during operation. The following advantages are not intended to describe essential features of the present disclosure, nor are the following advantages intended to represent an exhaust list. A skilled artisan will appreciate additional advantages conferred by the structures disclosed herein as will be apparent from the descriptions and drawings.

According to the present embodiment, the drain assembly 40 is configured such that an operator may drain coolant from the heat exchanger 1 in a directionally controlled manner while avoiding contact with the coolant. Specifically, the drain passage 411 and the drain plug 42 are provided to extend along the same direction, i.e., the height direction. Moreover, the drain plug 42 is disposed coaxially with the drain passage 411. Meanwhile, the engagement feature 421 of the drain plug 42 is on the opposite side of the housing 41 as the drain passage 411. As such, an operator may open or close the drain plug 42 to drain the coolant in a directionally controlled manner, while avoiding contact (e.g., accidental contact) with the coolant.

Accordingly to the present embodiment, the drain assembly 40 is provided as a bottom-flow drain, i.e., coolant directly drains from the bottom surface of the heat exchanger 1. This is because, as described above, the drain chamber 412 of the housing 41 is level with the bottom surface of the outlet tank 20. Then, the coolant flows directly downward through the drain passage 411. This bottom-flow drain design may reduce the package size of the heat exchanger 1. Further advantageously, this bottom flow drain configuration may provide drainage option for heat exchangers mounted with limited vehicle packaging space and/or service access in cross car and for/aft directions.

Second Embodiment

A second embodiment of the present disclosure will be described with respect to FIGS. 5 and 6.

Figure 5:
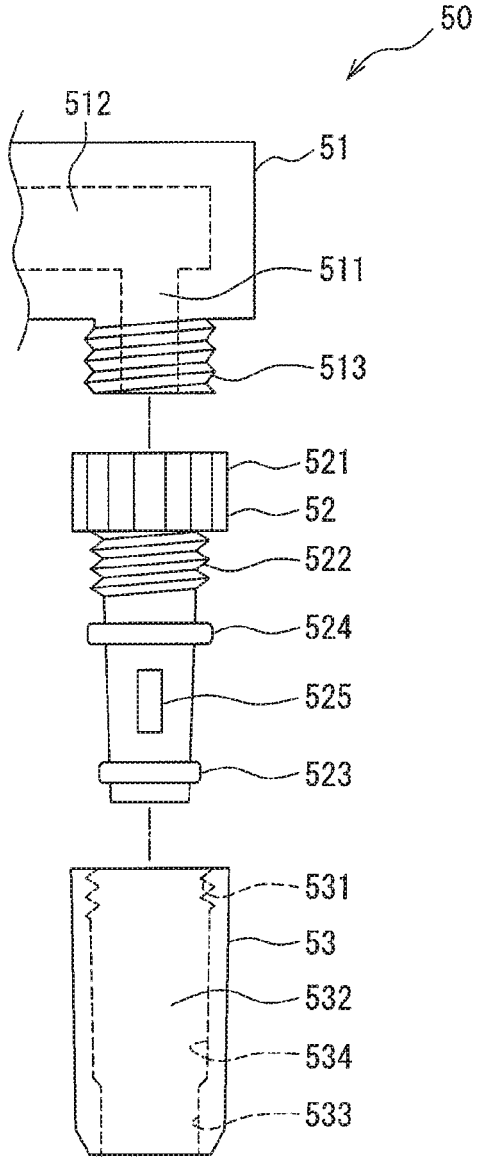
FIG. 5 is an exploded view of a drain assembly.

FIG. 5 is an exploded view of a drain assembly 50 according to the present embodiment. The drain assembly 50 includes a housing 51, and upper drain plug 52, and a lower drain plug 53.

As illustrated, a drain passage 511 and a drain chamber 512 are formed in the housing 51, in the same manner as the drain passage 411 and the drain chamber 412 of the housing 41 of the first embodiment. Accordingly, descriptions of these elements are omitted for the sake of brevity. In the present embodiment, the housing 51 also includes an outer threading 513 on the outer wall of the drain passage 511 that is an integrated part of the outlet tank 20.

The upper drain plug 52 is an integrally formed hollow body having a cylindrical shape. The top end of the upper drain plug 52 is open, while the bottom end of the upper drain plug 52 is closed. Here, an inner threading section 521 is formed at the top end portion of the upper drain plug 52. Specifically, the inner threading section 521 includes inner threading formed on the inner circumferential surface of the upper drain plug 52. The inner threading section 521 is configured to receive and engage with the outer threading 513 of the housing 51 to couple the upper drain plug 52 with the housing 51. In this case, the drain passage 511 of the housing 51 is connected to the inside of the upper drain plug 52. In addition, an outer threading section 522 is formed on the outer surface of the upper drain plug 52. In the present embodiment, the outer threading section 522 is adjacent to the inner threading section 521.

A first seal 523 and second seal 524 are secured to the outer surface of the upper drain plug 52. Similar to the first embodiment, the first seal 523 is located at a distal (i.e., lower) portion of the upper drain plug 52, while the second seal 524 is located at a proximal (i.e., higher) portion of the upper drain plug 52. The first seal 523 is formed with a smaller outer radius than the second seal 524. Other aspects of the first seal 523 and the second seal 524 (e.g., manner of being fixed to the upper drain plug 52) are the same as those of the first seal 423 and the second seal 424 of the first embodiment, and thus description of these points is omitted for brevity.

As described above, the bottom end of the upper drain plug 52 is closed. A side opening 525 is formed on the outer circumferential surface (i.e., the side wall) of the upper drain plug 52. The side opening 525 is in fluid communication with the inside of the upper drain plug 52. Accordingly, when the upper drain plug 52 is coupled to the housing 51, the inside of the outlet tank 20 is in fluid communication with the side opening 525 through the drain chamber 512 and the drain passage 511 of the housing 51. In the present embodiment, the side opening 525 is formed between the first seal 523 and the second seal 524 in the height direction (i.e., in the axial direction of the upper drain plug 52).

The lower drain plug 53 is an integrally formed hollow body having a cylindrical shape, thereby forming a plug passage 532 therein. Unlike the upper drain plug 52, both the top end and bottom end of the lower drain plug 53 are open. In other words, the lower drain plug 53 is formed as a pipe. An inner threading section 531 is formed on the inner circumferential surface (i.e., the inner side wall) at the top end portion of the lower drain plug 53. The inner threading section 531 of the lower drain plug 53 is configured to engage with the outer threading section 522 of the upper drain plug 52, thereby allowing the lower drain plug 53 to be assembled with the upper drain plug 52. Further, by threading or unthreading the inner threading section 531 with respect to the outer threading section 522, the lower drain plug 53 may be moved in the height direction with respect to the upper drain plug 52.

The lower drain plug 53 includes a first section 533 and a second section 534 along the axial direction of the lower drain plug 53. The first section 533 has a smaller inner circumferential radius than the second section 534. In other words, the cross section area of the plug passage 532 in the lower drain plug 53 is smaller in the first section 533 than in the second section 534. More specifically, the inner circumferential radius of the first section 533 is configured to be slightly smaller than the outer radius of the first seal 523 of the upper drain plug 52. Similarly, the inner circumferential radius of the second section 534 is configured to be slightly smaller than the outer radius of the second seal 524 of the upper drain plug 52. The inner threading section 531 is formed on the inner circumferential surface of the second section 534 of the lower drain plug 53.

Figure 6A:
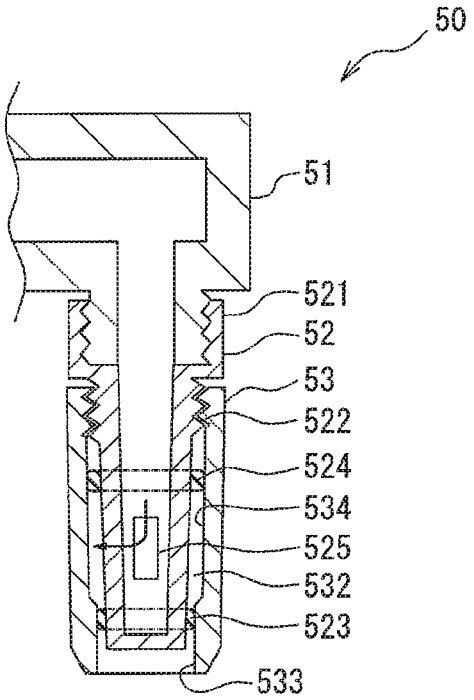
FIG. 6A is a cross section view of a drain assembly.
Figure 6B:
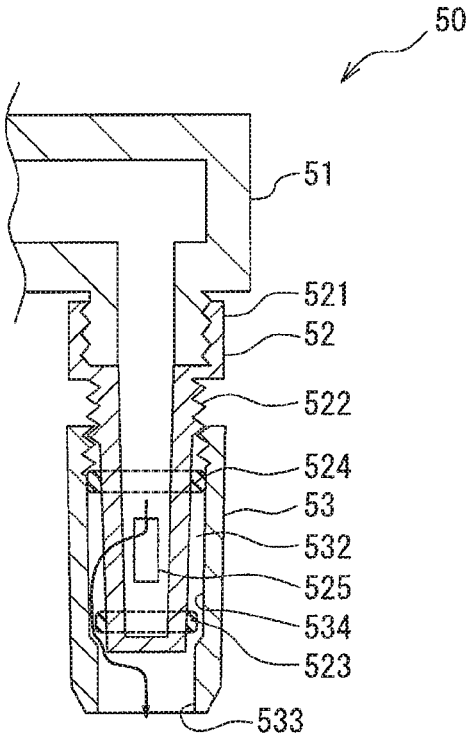
FIG. 6B is a cross section view of a drain assembly.

FIGS. 6A and 6B are cross section views showing the drain assembly 50 of the present embodiment in an assembled state. As illustrated, when the upper drain plug 52 and the lower drain plug 53 are assembled, the upper drain plug 52 is partially housed within the lower drain plug 53, such that both the first seal 523 and the second seal 524 are positioned within the lower drain plug 53. Accordingly, the side opening 525 of the upper drain plug 52 directly opens into the plug passage 532 of the lower drain plug 53.

FIG. 6A shows the lower drain plug 53 in a closed position. The lower drain plug 53 may be moved to this position by being rotated to thread the inner threading section 531 with respect to the outer threading section 522, thereby moving the lower drain plug 53 upward with respect to the upper drain plug 52. In this position, the first seal 523 of the upper drain plug 52 is in contact with the inner circumferential surface of the first section 533 of the lower drain plug 53. In addition, the second seal 524 of the upper drain plug 52 is in contact with the inner circumferential surface of the second section 534 of the lower drain plug 53. Accordingly, the plug passage 532 of the lower drain plug 53 is closed by both the first seal 523 and the second seal 524 of the upper drain plug 52.

While the lower drain plug 53 is in the closed position, although the side opening 525 of the upper drain plug 52 directly opens into the plug passage 532 of the lower drain plug 53, the plug passage 532 of the lower drain plug 53 is closed in both directions by the first seal 523 and the second seal 524, thereby forming a closed chamber. As shown by the arrow in FIG. 6A, any coolant flowing out from the side opening 525 is trapped in the plug passage 532, and therefore not allowed to drain out.

FIG. 6B shows the lower drain plug 53 in an open position. The lower drain plug 53 may be moved to this position by being rotated to unthread the inner threading section 531 with respect to the outer threading section 522, thereby moving the lower drain plug 53 downward with respect to the upper drain plug 52. In this position, both the first seal 523 and the second seal 524 of the upper drain plug 52 are disposed within the second section 534 of the lower drain plug 53. In other words, while the second seal 524 is in contact with the inner circumferential surface of the second section 534 of the lower drain plug 53, the first seal 523, which has a smaller outer radius than the second seal 524, is not in contact with the inner circumferential surface of the second section 534 of the lower drain plug 53.

While the lower drain plug 53 is in the open position, the plug passage 532 of the lower drain plug 53 is closed by only the second seal 524 of the upper drain plug 52. In this case, since the side opening 525 of the upper drain plug 52 directly opens into the plug passage 532 of the lower drain plug 53, any coolant flowing out from the side opening 525 freely flows downward through the plug passage 532, and exits through the first section 533 and the open end of the lower drain plug 53, as shown by the arrow in FIG. 6B.

The drain assembly 50 as described above confers numerous technical advantages during operation. The following advantages are not intended to describe essential features of the present disclosure, nor are the following advantages intended to represent an exhaust list. A skilled artisan will appreciate additional advantages conferred by the structures disclosed herein as will be apparent from the descriptions and drawings.

According to the present embodiment, the drain assembly 50 is configured such that an operator may drain coolant from the heat exchanger 1 in a directionally controlled manner while avoiding contact with the coolant. Specifically, the drain passage 511, the upper drain plug 52, the lower drain plug 53, and the plug passage 532 are all provided to extend along the same direction, i.e., the height direction. Moreover, the upper drain plug 52 and the lower drain plug 53 are disposed coaxially with the drain passage 511. Meanwhile, the lower drain plug 53 may be manipulated by an operator through the outer circumferential surface of the lower drain plug 53. For example, an operator may grab the top end portion of the lower drain plug 53 to thread or unthread the lower drain plug. As such, an operator may open or close the lower drain plug 53 to drain the coolant in a directionally controlled manner, while avoiding contact (e.g., accidental contact) with the coolant.

Accordingly to the present embodiment, the drain assembly 50 is provided as a bottom-flow drain, i.e., coolant directly drains from the bottom surface of the heat exchanger 1. This is because, as described above, the drain chamber 512 of the housing 51 is configured in the same manner as the drain chamber 412 of the first embodiment, and thus is level with the bottom surface of the outlet tank 20. Then, the coolant flows directly downward through the drain passage 511. This bottom-flow drain design may reduce the package size of the heat exchanger 1. Further advantageously, this bottom flow drain configuration may provide drainage option for heat exchangers mounted with limited vehicle packaging space and/or service access in cross car and for/aft directions.

Other Embodiments

The present disclosure is described with reference to the above embodiments, but these embodiments are not intended to be limiting. A variety of modifications which do not depart from the gist of the present disclosure are contemplated.

Figure 7:
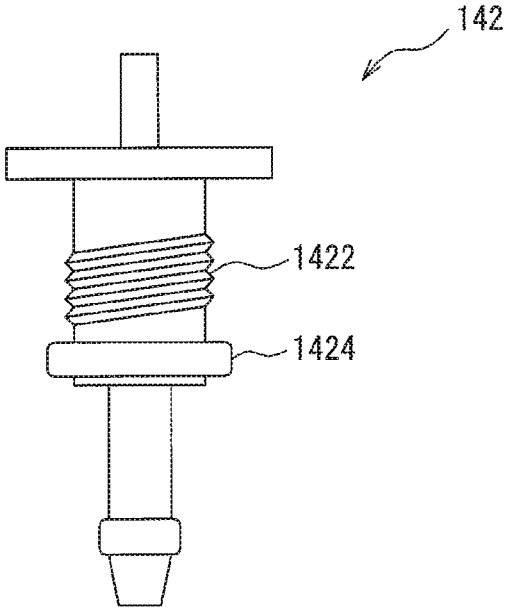
FIG. 7 is a front view of a drain plug.

In the first embodiment, an example is provided in which the second seal 424 is disposed higher than the threading 422 along the axial direction of the body 44. However, in an alternative embodiment shown in FIG. 7, a drain plug 142 may include a second seal 1424 which is disposed lower than a threading 1422. In this case, the lower second seal 1424 may prevent coolant from coming into contact with the threading 1422.

Figure 8:
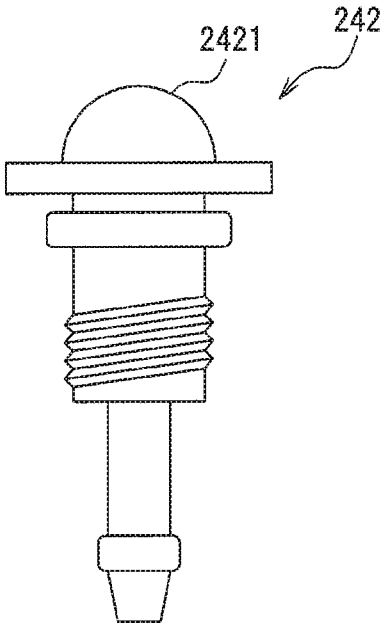
FIG. 8 is a front view of a drain plug.
Figure 9:
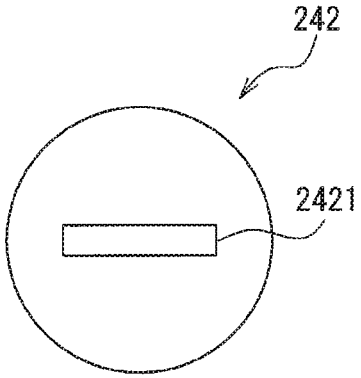
FIG. 9 is a top view of a drain plug.

In the first embodiment, an example is provided in which the engagement feature 421 is a hexagonal feature for engagement with a tool. However, in an alternative embodiment shown in FIGS. 8 and 9, a drain plug 242 may include an engagement feature 2421 which is shaped as a half-disc, thereby allowing hand manipulation by an operator.

In the second embodiment, an example is provided in which the upper drain plug 52 is configured to be coupled to the housing 51 through the inner threading section 521 engaging with the outer threading 513. However, in an alternative configuration, the upper drain plug 52 may be permanently secured to the housing 51 through, e.g., brazing. Further alternatively, the upper drain plug 52 may be integrally formed with the housing 51 through, e.g., metal casting, resin welding, or integrated resin molding. In this case, there is no need to specifically form the drain passage 511 separately from the upper drain plug 52.

In the first and second embodiments described above, the various sealing members may be secured to different surfaces instead. For instance, in the first embodiment, the first seal 423 may be fixed to the inner circumferential surface of the drain passage 411 instead. Similarly, the second seal 424 may be fixed to the inner circumferential surface of the plug chamber 413 instead. In the second embodiment, the first seal 523 or the second seal 524 may be fixed to the inner circumferential surface of the lower drain plug 53 instead.

In the first and second embodiments described above, the drain assembly is attached to the outlet tank. However, the drain assembly may be attached to the inlet tank instead. Further, FIG. 1 shows the heat exchanger as a single pass cross-flow heat exchanger, but the drain assembly described herein may be applied to a multi-pass cross-flow heat exchanger instead. Further, the drain assembly may be applied to a down-flow heat exchanger as well. In the case of a down-flow heat exchanger, the drain assembly would be attached to the lower tank. In view of this, the drain assembly may be referred to as being attached to a "first tank", which may be either the inlet tank or the outlet tank. A "second tank" would then refer to the tank to which the drain assembly is not attached.

In the first and second embodiments described above, the drain assembly is attached to the surface of the outlet tank that faces away from the inlet tank (i.e., the right side surface of the outlet tank as shown in the figures). However, the drain assembly may be attached to the front or rear surface of the outlet tank instead (i.e., facing into or out of the page in the figures).

In the figures, the specific shapes of the various passages, housings, drain plugs etc. are not intended to be limited to the specific illustrated shapes unless described otherwise. For instance, the upper drain plug and the lower drain plug in the second embodiment are illustrated with a slight tapered shape, but may instead be straight cylindrical shaped, or have a more tapered shape.

The use of terms such as "first", "second", etc. is solely for the purpose of identification, and is not intended to limit the order or relationships of applicable elements.

The invention claimed is:

1. A heat exchanger, comprising:

a first tank;

a second tank;

a plurality of fluid conduits that extend along a width direction to connect the first tank with the second tank, the plurality of fluid conduits being stacked along a height direction which is orthogonal to the width direction and being configured to carry a coolant to flow between the first tank and the second tank; and a drain assembly attached to the first tank, the drain assembly including a housing, an upper drain plug, and a lower drain plug, wherein, a drain passage is formed in the housing, the drain passage being an annular hole formed to extend along the height direction, the drain passage including a first end in fluid communication with the first tank, and a second end which is open, the upper drain plug is a hollow body having a cylindrical shape, the upper drain plug having an open end configured to engage with the drain passage to couple the upper drain plug to the housing, the upper drain plug includes:

a first seal secured to a distal section of the upper drain plug, a second seal secured to a proximal section of the upper drain plug, a side opening formed on an outer circumferential surface of the upper drain plug between the first seal and the second seal in an axial direction of the upper drain plug, the side opening being in fluid communication with an inside of the upper drain plug, an outer threading section formed on the outer circumferential surface of the upper drain plug, and the lower drain plug is a hollow body having a cylindrical shape and two open ends, the lower drain plug including:

a plug passage that extends between the two open ends of the lower drain plug, a first section and a second section along an axial direction of the lower drain plug, an inner circumferential radius of the first section being smaller than an inner circumferential radius of the second section, and an inner threading section formed on an inner circumferential surface of the lower drain plug, the lower drain plug is configured to be coupled to the upper drain plug and movable along the height direction to selectively open or close the plug passage.

2. The heat exchanger of claim 1, wherein the lower drain plug is configured to be coupled to the upper drain plug by engaging the inner threading section with the outer threading section, the drain passage of the housing being in fluid communication with the plug passage of the lower drain plug through the upper drain plug when the lower drain plug is coupled to the upper drain plug, the lower drain plug is movable along the height direction between an open position and a closed position with respect to the upper drain plug by threading or unthreading the inner threading section with the outer threading section, when the lower drain plug is in the closed position, the distal section of the upper drain plug is disposed inside the first section of the lower drain plug such that the first seal blocks the first section of the lower drain plug, and the proximal section of the upper drain plug is disposed inside second section of the lower drain plug such that the second seal blocks the second section of the lower drain plug, and when the lower drain plug is in the open position, the lower drain plug is displaced away from the upper drain plug as compared to when the lower drain plug is in the closed position, such that the first seal is outside of the first section of the lower drain plug.

3. The heat exchanger of claim 2, wherein an outer radius of the first seal is greater than the inner circumferential radius of the first section of the lower drain plug, and an outer radius of the second seal is greater than the inner circumferential radius of the second section of the lower drain plug.

4. The heat exchanger of claim 3, wherein the first seal and the second seal are secured to the upper drain plug through corresponding annular grooves formed on the outer circumferential surface of the upper drain plug.

5. The heat exchanger of claim 4, wherein the first seal and the second seal are rubber O-rings.

6. The heat exchanger of claim 1, wherein the upper drain plug is permanently fixed to the housing through brazing or resin welding.

7. The heat exchanger of claim 1, wherein the upper drain plug is integrally formed with the housing.

8. The heat exchanger of claim 1, wherein the heat exchanger is a cross-flow heat exchanger.

9. The heat exchanger of claim 1, wherein the heat exchanger is a down-flow heat exchanger.

* * * * *